US009586662B2

(12) United States Patent
Cyr

(10) Patent No.: US 9,586,662 B2
(45) Date of Patent: Mar. 7, 2017

(54) KAYAK PADDLE EXTENSION

(71) Applicant: Re'al Cyr, Millinocket, ME (US)

(72) Inventor: Re'al Cyr, Millinocket, ME (US)

( * ) Notice: Subject to any disclaimer, the term of this patent is extended or adjusted under 35 U.S.C. 154(b) by 0 days.

(21) Appl. No.: 14/877,834

(22) Filed: Oct. 7, 2015

(65) Prior Publication Data

US 2016/0096606 A1 Apr. 7, 2016

Related U.S. Application Data

(60) Provisional application No. 62/060,648, filed on Oct. 7, 2014.

(51) Int. Cl.
*B63H 16/04* (2006.01)

(52) U.S. Cl.
CPC ..... *B63H 16/04* (2013.01)

(58) Field of Classification Search
CPC ..... B63H 16/00; B63H 16/04; B63H 16/10
USPC ..... 440/101
See application file for complete search history.

(56) References Cited

U.S. PATENT DOCUMENTS

| | | | | |
|---|---|---|---|---|
| 4,820,216 | A * | 4/1989 | Masters | B63H 16/04 440/101 |
| 6,022,255 | A * | 2/2000 | Lukanovich | B63H 16/04 440/101 |
| 6,328,617 | B1 * | 12/2001 | Gunnell | B63H 16/04 440/101 |
| 7,367,858 | B2 * | 5/2008 | Matuska | B63H 16/04 440/101 |
| 8,235,760 | B2 * | 8/2012 | Rechner | B63H 16/04 440/101 |
| 8,801,483 | B2 * | 8/2014 | Kicker | B63H 16/04 440/101 |
| 2004/0048529 | A1 * | 3/2004 | Kutny Splaine | B63H 16/04 440/101 |

* cited by examiner

*Primary Examiner* — Lars A Olson
(74) *Attorney, Agent, or Firm* — Michael L. Greenberg, Esq.; Greenberg & Lieberman, LLC

(57) ABSTRACT

A paddle device configured with adjustable paddle-blades at both a first end and a second end is described. The paddle device is equipped with a center padded grip area, which functions as a center extender couple for adapting to conventional oars or paddles in an alternate embodiment described. The paddle device is configured to conjoin two paddles or oars together such to create a larger alternating paddle, configured to effectively expedite the paddling process on paddle boards and other similar small single-paddle, manual craft by eliminating the need to alternate hands while paddling.

1 Claim, 2 Drawing Sheets

KAYAK PADDLE EXTENSION

CONTINUITY

This application is a non-provisional application of provisional patent application No. 62/060,648, filed on Oct. 7, 2014, and priority is claimed thereto.

FIELD OF THE PRESENT INVENTION

The present invention relates generally to paddles and oars, and more specifically, to an adaptor for a kayak paddle configured to expedite the paddling process, and facilitate faster movement of the board, boat, or other water craft by providing a dual-paddle design.

BACKGROUND OF THE PRESENT INVENTION

The basic mechanics of propulsion over water have changed little in hundreds of years. Although engines employing outboards and impellers have been fashioned to expedite transit over water, many individuals still prefer to peacefully glide along the water under their own power with the classic oar or paddle. While manual propulsion over water can be relaxing and great exercise, there are limits to the speed that can be attained piloting a small craft such as a paddle board, canoe, kayak, or other similar small craft.

Paddle boards, boards in which the individual stands while riding and piloting the craft are among the slower forms of paddle-based water transit, as much wind resistance is generated by the individual standing on the board. Similarly, the user piloting the board only has room for one paddle, which the user must alternate use on each side of the paddle board in order to move in a straight line. Conventionally, this single paddle is equipped with a handle at one end, and a paddle-blade on the opposite end, which is contoured to maximize the efficacy of the paddle on both sides of the paddle board equally.

As such, the single paddle blade is not specially crafted and contoured to propel water in a single direction, but instead, is capable of being switched to the user's opposite hand, without rotating the paddle, in order to propel the paddle board. However, some higher end paddles are contoured for a single side of the craft, and are configured to be turned or to turn in the hand of the user in accordance with which direction the paddle is being pushed through the water. Given that the user must alternate hands between each few strokes of the paddle, it can be clearly seen that attempting to go fast on a paddle-board quickly becomes a tiring activity.

Thus, there is a need for a device that is equipped with a paddle-blade on each end of the paddling device. Similarly, there is a need for a device capable of converting a conventional paddle or oar into a double-tipped alternating paddle, configured to expedite the paddling process by providing effectively two paddles to the user, eliminating the need for the user to alternate hands with the paddle when used in a single-paddle craft.

SUMMARY OF THE PRESENT INVENTION

The present invention is an adaptive paddling device configured to expedite the locomotion of a water craft by applied manpower. The present invention has an outer grip area which is preferably heavily padded, and is used by the user to hold the present invention while in use. The present invention is equipped with a first blade disposed at a first end of the present invention, and a second blade disposed at a second end of the present invention. The outer grip preferably comprises the center of the present invention, and is preferably placed at or near the center of gravity of the present invention.

The preferred embodiment of the present invention is a uni-body, dual ended paddle or oar which is user-adjustable in order to achieve the ideal length. The body of the present invention is preferably configured to telescope in and out in order to facilitate lengthening and shortening of the present invention. The adjustment is helpful if the present invention is to be used with differing types of water craft, such as between a stand-up paddle board, or a conventional canoe.

Alternate embodiments of the present invention are envisioned to adapt existing oars or paddles into the present invention via a center coupling placed within the outer grip area of the center of the present invention. The coupling is preferably equipped to affix to specially modulated paddles or oars via conventional spring-loaded, push-button locking mechanisms, similar to those found on a conventional folding umbrella.

DETAILED DESCRIPTION OF THE PREFERRED EMBODIMENT

Figure 1:
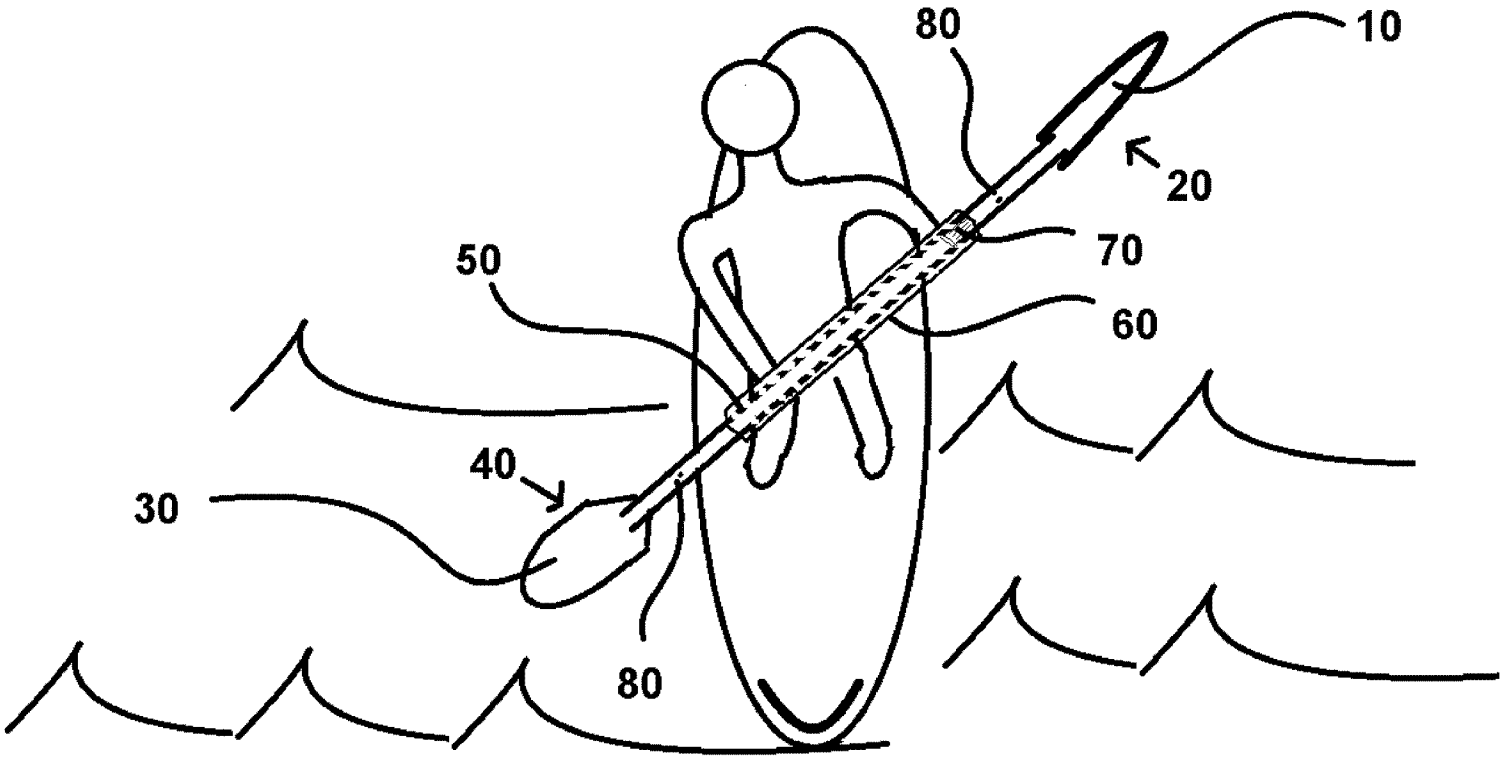
FIG. 1 displays the present invention in use by a user on a paddle board, as seen from the front.
Figure 2:
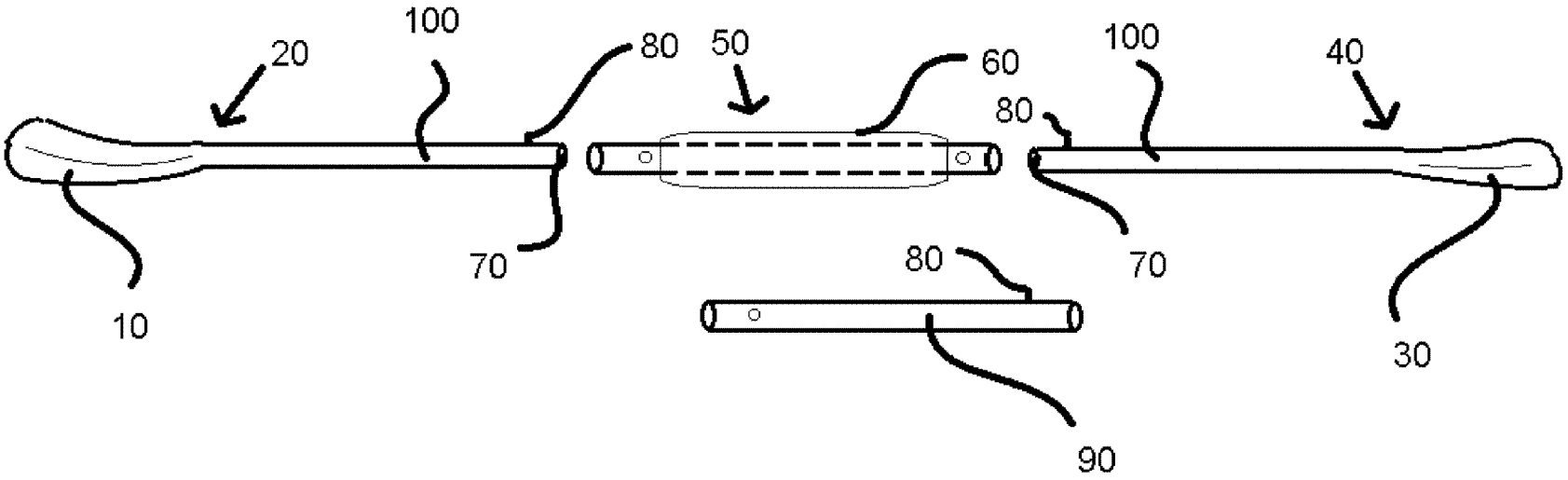
FIG. 2 exhibits a close-up view of the present invention as seen from the side.

The present invention is a paddle device equipped with a first paddle blade (10) at a first end (20) and a second paddle blade (30) at a second end (40). Unlike conventional paddles which are equipped with a single paddle blade, the present invention employs two in order to expedite the paddling process by eliminating the need for the user to alternate hand positioning during alternating strokes. In the preferred embodiment of the present invention, it is envisioned that the first paddle blade (10) at the first end (20) is preferably offset from said second paddle blade (30) at said second end (40).

The preferred embodiment of the present invention is equipped with a center coupling member (50) which is preferably encased within a padded grip (60) which circumscribes the center coupling member (50), providing an effective and comfortable grip for the user while the present invention is in use. The padded grip (60) is preferably composed of a foam or polyurethane-based grip agent, similar to a conventional pool noodle toy, facilitating a sturdy and comfortable grip of the present invention during use. The foam employed by the present invention preferably enables the present invention to float. Likewise, the foam of the padded grip (60) is preferably adequately padded with up to two inches of foam in order to help prevent injury during use of a paddle board with the present invention, such as when the user falls off of the paddle board. Each the first paddle blade (10) and the second paddle blade (40), when not affixed to the center coupling member (50), are equipped with cylindrical extensions (100) extending away from the paddle, which are optional to use.

Some embodiments of the present invention embody solely the center coupling member (50), which is configured to be equipped with conventional kayak paddle ends. In all embodiments of the present invention, the center coupling member (50) is preferably equipped with the padded grip (60), making the present invention more comfortable to use, as well as to provide added grip to the user of the present invention such that he or she is less likely to drop the present invention accidentally. It should be understood that the padded grip (60) of the present invention functions as the handle of the device. The padded grip (60) may be equipped with one or more indentations in the shape of a hand wrapped around the padded grip (60) to facilitate ergonomic use of the present invention.

In some embodiments of the present invention, the center coupling member (50) is preferably equipped with at least one connector (70) configured to facilitate and expedite connection of the center coupling member (50) to modified conventional oars or paddles. The connection is preferably established by inserting the at least one connector (70), which may simply amount to an extended, telescoping pole, within the hollow oar or paddle to be fitted to the center coupling member (50) of the present invention.

In this embodiment of the present invention, the oars or paddles that are modified for use with the center coupling member (50) effectively function as the first paddle blade (10) and the second paddle blade (30). Small, spring loaded tension springs are preferably used to secure the center coupling member (50) with a push button locking mechanism (80) to the cylindrical extensions (100) of both the first paddle blade (10) and the second paddle blade (30), similar to a conventional telescoping umbrella. While push-button locking mechanisms (80) are preferably employed, it is envisioned that alternate locking mechanisms may be used to facilitate the connection and temporary mounting of the paddle extensions (100) to the center coupling member (50).

It is envisioned that the center coupling member (50) may be employed and marketed, on its own, such that it is configured to receive the non-paddle-equipped side—the cylindrical extensions (100)—of two conventional kayak paddles, one disposed and held within the first end of the center coupling member via the spring loaded tension springs, and the second end of the center coupling member. The conventional kayak paddles, in this scenario, are preferably cut or modified to function with the center coupling member (50) of the present invention. As such, it is envisioned that center coupling member (50) of the present invention be manufactured in a variety of diameters, or bundled with at least one adapter that provides for the connection of the center coupling member (50) to modified kayak paddles of varying diameters.

The center coupling member (50) of the present invention is preferably made of a rust-proof or rust-resistant metal or metallic alloy which may be painted to provide additional protection against the corrosive properties of salt water. It is envisioned that the padded grip (60) of the present invention may be a wide variety of colors, and may be textured, ribbed, or ridged in order to provide an optimal placement and grip for the hands of the user.

The preferred embodiment of the present invention is a uni-body model, configured at the factory to be fitted with specially designed paddles to be employed as the first paddle blade (10) and the second paddle blade (30). The first paddle blade (10) and the second paddle blade (30) are preferably crafted such that they compliment each other's stroke, and are off-set in order to facilitate effective and expedient paddling. Each the first paddle blade (10) and the second paddle blade (30) are preferably curved or contoured in the same direction, so as to maximize thrust of each stroke from each side of the craft, however they are preferably not angled in an identical orientation. Thus, the first paddle blade (10) is preferably off-set from the second paddle blade (30) at nearly a 90 degree angle such that when the first paddle blade (10) is being pushed through the water, the second paddle blade (30) is angled to slice through the wind, providing minimal resistance to the manual propulsion system facilitated by the present invention.

It should be understood that the present invention employs spring, push-button locking mechanisms for securing the paddle handles to the center coupling member (50) of the present invention, however other conventional locking mechanisms may be employed as well. It is envisioned that the center coupling member (50) of the present invention is configured to connect to modified, existing, and/or pre-purchased paddles, as well as proprietary paddles designed to function solely with the center coupling member (50) of the present invention. In such embodiments, the center coupling member (50) may be configured to receive a uniquely shaped connector disposed on the handles of the paddles. Additionally, more than one interlocking segment may comprise the center coupling member (50) to facilitate an adjustment of the overall length of the present invention, providing for the center coupling member (50) to function with a paddles from a variety of manufacturers, as well as to provide a means of adjustment in length to the preference of the user. An optional extender (90) is available, and is preferably bundled with the present invention to facilitate this modification. It should be understood that the at least one connector (70) maybe either female or male in disposition.

Additionally, the preferred method of use of the present invention is as follows:

First, the user inserts the first paddle extension into a first end of the center coupling member (50). Each the first paddle extension and the second paddle extension are equipped with a paddle blade. The user then inserts the second paddle extension into the second end of the center coupling member (50). As the first paddle extension and the second paddle extension are connected to the center coupling member (50), locking mechanisms are employed to secure the paddle extensions to the center coupling member (50) of the present invention. The padded grip (60), if not already installed, is slid onto or wrapped around the center coupling member (50). Some embodiments of the present invention have the padded grip (60) permanently bonded to the center coupling member (50). Then, the user is free to board the personal watercraft, grip the present invention by the padded grip (60), and propel the watercraft with a rotational motion, alternating use of the first paddle blade and the second paddle blade in the water.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A method for propelling a small personal watercraft manually comprising:

inserting a first paddle extension into a first end of a center coupling member;

wherein said first paddle extension is equipped with a first paddle;

inserting a second paddle extension into a second end of a center coupling member;

wherein said second paddle extension is equipped with a second paddle;

locking the first paddle extension to the first end of the center coupling member with a first spring locking mechanism;

locking the second paddle extension to the second end of the center coupling member with a second spring locking mechanism;

wrapping the center coupling member with padding;

wherein the padding has hand-shaped indentations;

gripping the padding; and propelling the personal watercraft with a rotational motion alternating use of the first paddle and the second paddle in the water.

* * * * *